US010524589B2

(12) United States Patent
Donegan

(10) Patent No.: US 10,524,589 B2
(45) Date of Patent: Jan. 7, 2020

(54) SHIP FLAT HUTCH WITH AUTO BOTTOM

(71) Applicant: Menasha Corporation, Neenah, WI (US)

(72) Inventor: Michael P. Donegan, Cherry Hill, NJ (US)

(73) Assignee: Menasha Corporation, Neenah, WI (US)

( * ) Notice: Subject to any disclaimer, the term of this patent is extended or adjusted under 35 U.S.C. 154(b) by 0 days.

(21) Appl. No.: 16/015,731

(22) Filed: Jun. 22, 2018

(65) Prior Publication Data

US 2019/0090663 A1 Mar. 28, 2019

Related U.S. Application Data

(60) Provisional application No. 62/524,087, filed on Jun. 23, 2017, provisional application No. 62/546,940, filed on Aug. 17, 2017.

(51) Int. Cl.
*A47F 5/11* (2006.01)
*A47B 43/02* (2006.01)
(Continued)

(52) U.S. Cl.
CPC ..... *A47F 5/116* (2013.01); *A47B 43/02* (2013.01); *A47B 55/06* (2013.01); *A47F 5/10* (2013.01); *A47F 5/112* (2013.01); *A47F 5/114* (2013.01)

(58) Field of Classification Search
CPC .. A47F 5/11; A47F 5/114; A47F 5/116; A47F 5/112; A47F 5/118; A47F 5/0025;
(Continued)

(56) References Cited

U.S. PATENT DOCUMENTS 1,827,008 A 10/1931 Huckel
1,912,847 A 6/1933 Earl
(Continued)

FOREIGN PATENT DOCUMENTS

EP 0629557 A1 12/1994
JP 06278746 A 10/1994

OTHER PUBLICATIONS

Leblanc, Rick; "Limits on Export Pallets Creating Corrugated Window of Opportunity; Corrugated Pallet Suppliers Experiencing Renewed Interest for Export, Domestic Markets," http://www.palletenterprise.com/articledatabase/view.asp?articleID-648; 4 pages; Apr. 1, 2002.

(Continued)

*Primary Examiner* — Hiwot E Tefera
(74) *Attorney, Agent, or Firm* — Joseph A. Fuchs; Greensfelder, Hemker & Gale, P.C.

(57) ABSTRACT

The present invention provides a fold flat assembly capable of being erected into a display hutch having a shell and a tray assembly attached to an inner surface of the shell. The shell has opposed side walls spaced from one another and each having a front edge and a rear edge. A back panel connects the rear edges and a plurality slats connect portions of the front edges of the opposing side walls and are spaced from one another defining gaps between adjacent slats. The shell is moveable between a flat position and an erect position. The tray assembly has a peripheral wall and a bottom wall. The peripheral wall is connected to the back panel, the opposed side walls and one of the slats of the plurality of slats. The bottom wall is connected by a first hinge to a segment of the peripheral wall. The tray assembly folds flat within the shell and a portion of the bottom wall extends into one of the gaps when the shell is in the flat position, and the
(Continued)

bottom wall forms a shelf, spanning from the one slat to the back panel, when the shell is in the erect position.

22 Claims, 4 Drawing Sheets

(51) Int. Cl.
*A47B 55/06* (2006.01)
*A47F 5/10* (2006.01)

(58) Field of Classification Search
CPC ..... A47F 5/0043; A47B 43/02; A47B 47/06; A47B 55/06; A47B 45/00; A47B 43/00; A47B 47/00
USPC ..... 211/135, 72, 73, 149, 186, 126.16, 195, 211/132.1, 70.1; 248/174, 152, 459; 108/165, 99; 229/108.1, 120.31, 120.15
See application file for complete search history.

(56) References Cited

U.S. PATENT DOCUMENTS 1,992,373 A 2/1935 Johnson
2,018,707 A 10/1935 Daller
D104,437 S 5/1937 Bulman
D146,386 S 2/1947 Shield
D153,188 S 3/1949 Stensgaard
D158,775 S 5/1950 Malkin
D158,776 S 5/1950 Malkin
2,666,531 A * 1/1954 Anderson, Jr. ..... A47F 5/112 108/99
2,706,066 A 4/1955 Wells
2,798,685 A 7/1957 Mooney
2,944,555 A 7/1960 Peel et al.
2,975,890 A 3/1961 Block
2,997,222 A * 8/1961 Sperry ..... A47F 5/112 211/130.1
3,000,602 A 9/1961 O'Brien
3,026,015 A 3/1962 Severn
3,058,646 A 10/1962 Guyer
3,161,341 A 12/1964 Farquhar
D204,434 S 4/1966 Kingsford
3,480,196 A 11/1969 Simas
3,528,559 A 9/1970 Miller
3,690,118 A 9/1972 Rainwater
3,696,990 A 10/1972 Dewhurst
3,730,417 A 5/1973 Lawson
3,857,494 A 12/1974 Giardini
3,879,053 A 4/1975 Chvala
3,886,348 A 5/1975 Jonathan et al.
3,944,128 A 3/1976 Hogan
D239,805 S 5/1976 South
4,004,691 A 1/1977 Wihksne
D244,117 S 4/1977 Naylor
4,085,847 A 4/1978 Jacalone
4,099,813 A 7/1978 Olivan
4,171,741 A 10/1979 Fish
4,283,000 A 8/1981 White
4,292,901 A 10/1981 Cox
3,026,078 A 3/1982 Simkins
4,375,874 A 3/1983 Leotta et al.
4,376,558 A 3/1983 Bandar
4,503,973 A 3/1985 Anderson
4,506,790 A * 3/1985 Muscari ..... A47F 5/116 108/180
D278,493 S 4/1985 Brescia et al.
4,512,541 A * 4/1985 Lietzke ..... A47F 5/112 206/45.25
4,602,735 A 7/1986 Aaron
4,610,355 A 9/1986 Maurer
4,618,115 A * 10/1986 Belokin, Jr. ..... A47F 5/116 211/135
4,630,740 A * 12/1986 Belokin, Jr. ..... A47F 5/116 211/194
4,658,984 A 4/1987 Brunner
4,673,092 A 6/1987 Lamson et al.
4,688,716 A 8/1987 Winterling
D292,659 S 11/1987 Svezia et al.
D293,520 S 1/1988 Ovitz, III
4,722,473 A 2/1988 Sandrini et al.
D294,908 S 3/1988 Childress
4,765,492 A 8/1988 Howard et al.
4,793,664 A 12/1988 Jackson
4,826,265 A 5/1989 Hockenberry
4,836,379 A 6/1989 Shaw
4,850,284 A 7/1989 DeGroot et al.
4,852,756 A 8/1989 Holladay
4,863,024 A 9/1989 Booth
4,871,067 A 10/1989 Valenti
4,877,137 A 10/1989 Govang et al.
4,911,084 A 3/1990 Sato et al.
4,936,470 A 6/1990 Prindle
D321,100 S 10/1991 Dorrell
D321,295 S 11/1991 Nuebler
D321,615 S 11/1991 Lavine et al.
5,067,418 A 11/1991 Carter
D322,883 S 1/1992 Cain
5,119,740 A 6/1992 Carter
5,125,520 A 6/1992 Kawasaki
5,176,265 A 1/1993 Bennett
5,183,166 A * 2/1993 Belokin, Jr. ..... A47F 5/116 211/130.1
5,195,440 A 3/1993 Gottlieb
5,213,220 A 5/1993 McBride
5,259,631 A 11/1993 Brande
5,269,219 A 12/1993 Juvik-Woods
5,272,990 A 12/1993 Carter
2,339,656 A 1/1994 Shina
D349,202 S 8/1994 Eliades et al.
D351,076 S 10/1994 Eliades et al.
5,357,875 A 10/1994 Winebarger et al.
5,388,531 A 2/1995 Crews et al.
5,413,053 A 5/1995 Vannatta
5,427,019 A 6/1995 Moorman
D362,768 S 10/1995 Lechleiter et al.
D363,840 S 11/1995 Weshler
5,465,672 A 11/1995 Boyse et al.
5,487,344 A 1/1996 Hutchinson
5,487,345 A 1/1996 Winebarger et al.
D369,035 S 4/1996 Potter
D369,043 S 4/1996 Parker
5,520,120 A 5/1996 Badger
5,528,994 A 6/1996 Iseli
5,540,536 A 7/1996 Hoedl
5,543,205 A 8/1996 Liebel
5,590,606 A 1/1997 Crews et al.
5,603,258 A 2/1997 Besaw
5,622,306 A 4/1997 Grigsby et al.
5,672,412 A 9/1997 Phares et al.
5,678,492 A * 10/1997 Pinkstone ..... A47B 43/02 108/165
5,685,234 A 11/1997 Grigsby et al.
D388,905 S 1/1998 Wells
5,706,953 A 1/1998 Polvere
5,711,423 A 1/1998 Fuller, Jr.
5,715,623 A 2/1998 Mackey, III
D395,534 S 6/1998 Besaw
5,762,213 A 6/1998 Heneveld, Sr.
5,791,487 A 8/1998 Dixon
5,794,542 A 8/1998 Besaw
5,797,499 A 8/1998 Pinco
D398,461 S 9/1998 Baluk et al.
D398,462 S 9/1998 Baluk et al.
5,809,903 A 9/1998 Young, Jr.
5,816,172 A 10/1998 Carter
5,826,732 A 10/1998 Ragsdale
5,832,841 A 11/1998 Crews et al.
5,881,652 A 3/1999 Besaw
D412,253 S 7/1999 Brozak, Jr.
5,918,744 A 7/1999 Bringard et al.
5,950,914 A 9/1999 Dunton et al.
5,980,008 A 11/1999 Stoever
5,996,366 A 12/1999 Renard

(56) References Cited

U.S. PATENT DOCUMENTS

| | | | | |
|---|---|---|---|---|
| 5,996,510 | A | 12/1999 | Harpman et al. | |
| D419,275 | S | 1/2000 | Carter | |
| D419,744 | S | 1/2000 | Carter | |
| 6,012,399 | A | 1/2000 | Carter | |
| 6,070,726 | A | 1/2000 | Carter | |
| 6,076,475 | A | 6/2000 | Kuhn et al. | |
| D428,738 | S | 8/2000 | Brozak, Jr. | |
| 6,126,131 | A | 10/2000 | Tietz | |
| 6,135,030 | A | 10/2000 | Besaw | |
| D433,782 | S | 11/2000 | Carter | |
| D433,839 | S | 11/2000 | Culbertson | |
| 6,145,671 | A | 11/2000 | Riga et al. | |
| 6,164,215 | A | 12/2000 | Cook et al. | |
| 6,189,778 | B1 | 2/2001 | Kanter | |
| D453,057 | S | 1/2002 | Sewell | |
| 6,354,229 | B1 | 3/2002 | Heidtke | |
| 6,357,587 | B1 | 3/2002 | Melms, Jr. | |
| 6,394,003 | B1 | 5/2002 | Lacy, III | |
| D461,334 | S | 8/2002 | Johnson et al. | |
| D464,498 | S | 10/2002 | Riga et al. | |
| 6,510,982 | B2 | 1/2003 | White et al. | |
| 6,585,118 | B2 | 7/2003 | Kellogg | |
| 6,612,247 | B1 | 9/2003 | Pistner et al. | |
| 6,659,295 | B1 | 12/2003 | De Land et al. | |
| 6,729,484 | B2 | 5/2004 | Sparkowski | |
| 6,769,368 | B2 | 8/2004 | Underbrink et al. | |
| D495,901 | S | 9/2004 | Bosman | |
| 6,814,245 | B2 | 11/2004 | Leclerc et al. | |
| 6,902,074 | B2 | 6/2005 | Albrecht | |
| 6,905,021 | B2 | 6/2005 | Polumbaum et al. | |
| D509,382 | S | 9/2005 | Ralle | |
| 6,951,300 | B2 | 10/2005 | Caille et al. | |
| D521,275 | S | 5/2006 | Dusenberry | |
| 7,036,196 | B2 | 5/2006 | Salatin et al. | |
| 7,066,342 | B2 | 6/2006 | Baechle et al. | |
| 7,066,380 | B2 | 6/2006 | Blake | |
| 7,089,872 | B2 | 8/2006 | Wintermute, II et al. | |
| 7,111,735 | B2 | 9/2006 | Lowry | |
| 7,137,517 | B2 | 11/2006 | Lowry et al. | |
| D533,734 | S | 12/2006 | Campbell | |
| 7,191,906 | B1 | 3/2007 | Pinco | |
| 7,234,604 | B2 | 6/2007 | Eisele | |
| D566,989 | S | 4/2008 | Mason | |
| D576,426 | S | 9/2008 | Yuen-Schat et al. | |
| D578,804 | S | 10/2008 | Norman et al. | |
| 7,546,926 | B2 | 6/2009 | Stolle et al. | |
| 7,546,927 | B2 | 6/2009 | Lowry et al. | |
| D603,189 | S | 11/2009 | Ralle | |
| 7,650,996 | B2 | 1/2010 | Mark | |
| 7,677,433 | B2 * | 3/2010 | Little | B65D 5/526 206/744 |
| 7,703,665 | B2 | 4/2010 | McGowan | |
| 7,703,864 | B2 * | 4/2010 | Moser | B65D 5/5213 206/747 |
| 7,717,265 | B2 | 5/2010 | Honkawa et al. | |
| 7,726,474 | B2 | 6/2010 | Berger et al. | |
| 7,828,169 | B2 | 11/2010 | Robinson et al. | |
| 7,992,716 | B2 | 8/2011 | Jackson | |
| 8,002,171 | B2 | 8/2011 | Ryan et al. | |
| 8,141,713 | B2 | 3/2012 | Farkas et al. | |
| 8,317,039 | B2 | 11/2012 | Norman | |
| 8,485,370 | B2 * | 7/2013 | Dewhurst | A47F 5/116 211/135 |
| 8,857,633 | B2 | 10/2014 | Dewhurst | |
| 9,211,021 | B2 * | 12/2015 | Smith | A47F 5/116 |
| 9,474,389 | B2 | 10/2016 | Pfeifer et al. | |
| 9,743,783 | B1 | 8/2017 | Bersamin | |
| 9,844,282 | B2 | 12/2017 | Smith | |
| 9,918,569 | B1 * | 3/2018 | Abel | A47F 5/112 |
| 10,117,529 | B2 | 11/2018 | Abel | |
| 10,123,635 | B2 * | 11/2018 | Lilja | A47B 43/02 |
| 10,159,362 | B2 | 12/2018 | Smith | |
| 2002/0189507 | A1 | 12/2002 | Benner | |
| 2003/0042828 | A1 | 3/2003 | Bonin | |
| 2003/0111383 | A1 | 6/2003 | Qiu et al. | |
| 2005/0252872 | A1 | 11/2005 | Elsele | |
| 2005/0274684 | A1 | 12/2005 | Swanson | |
| 2006/0006096 | A1 | 1/2006 | Funk | |
| 2006/0283775 | A1 | 12/2006 | Mark | |
| 2007/0193479 | A1 | 8/2007 | Slaats | |
| 2009/0107940 | A1 | 4/2009 | Norman et al. | |
| 2009/0127150 | A1 | 5/2009 | Meers | |
| 2010/0006529 | A1 * | 1/2010 | Groff | A47F 5/116 211/186 |
| 2010/0025344 | A1 | 2/2010 | Virvo | |
| 2010/0133215 | A1 | 6/2010 | Norman | |
| 2011/0000955 | A1 | 1/2011 | Manteufel et al. | |
| 2011/0049072 | A1 | 3/2011 | Dewhurst | |
| 2011/0266177 | A1 | 11/2011 | Lowry et al. | |
| 2012/0074037 | A1 | 3/2012 | Orschak et al. | |
| 2013/0097903 | A1 | 4/2013 | Gerstner | |
| 2013/0213915 | A1 | 8/2013 | Pfeifer et al. | |
| 2014/0217047 | A1 | 8/2014 | Frost | |
| 2015/0136720 | A1 * | 5/2015 | Miller | A47F 5/112 211/135 |
| 2016/0066711 | A1 * | 3/2016 | Mestres Armengol | A47F 5/116 211/135 |
| 2017/0079449 | A1 * | 3/2017 | Smith | A47F 5/116 |
| 2017/0295927 | A1 | 10/2017 | Gibbons, Jr. et al. | |
| 2018/0070747 | A1 * | 3/2018 | Smith | A47F 5/116 |
| 2018/0146803 | A1 | 5/2018 | Urban | |
| 2018/0160825 | A1 | 6/2018 | Abel | |
| 2018/0289178 | A1 * | 10/2018 | McMillan-Sweat | A47F 5/116 |
| 2019/0008290 | A1 | 1/2019 | Ertl | |
| 2019/0069694 | A1 | 3/2019 | Smith | |

OTHER PUBLICATIONS

"Solid Wood Packing Materials to Argentina;" http://www.corrugatedprices.com/pallets/swang.html; 2 pages; Feb. 5, 2002. Note: Applicant was unable to locate a copy of this reference; however, it believes that a copy is available to the Examiner in the application file for U.S. Appl. No. 12/621,221 at the U.S. Patent and Trademark Office.

* cited by examiner

SHIP FLAT HUTCH WITH AUTO BOTTOM

CROSS-REFERENCE TO RELATED APPLICATIONS

The present invention claims the benefit of U.S. Provisional Patent Application Nos. 62/524,087 filed Jun. 23, 2017 and 62/546,940, filed Aug. 17, 2017, the contents of which are incorporated in their entirety herein by reference and made a part hereof.

FEDERALLY SPONSORED RESEARCH OR DEVELOPMENT

N/A

FIELD OF THE INVENTION

The present invention provides a hutch for displaying goods in a retail environment that can be folded into a flat position and moved to an erect position. The hutch can be shipped in the flat position and pressed by hand into the erect position by an end user without the use of tools, glue or tape. The hutch can also be folded back into a flat position for ease of storage, disposal and recycling.

DESCRIPTION OF THE PRIOR ART

Point of purchase displays are widely used for sale of products in a retail environment. Some displays are made from paperboard material and are lightweight. Often-times paperboard displays are used during a short promotional period of time where the displayed items are sold at reduced prices. After the promotional period, the display can be disposed of or recycled. Point of purchase displays often are carried to a retail location by a sales staff member, erected on site and loaded with products for sale. This requires considerable time and effort and expense for the product seller. Notwithstanding, such displays are utilized as they typically are effective for bringing attention to the products and allows for setting the displayed products apart from other products on large shelving units.

SUMMARY OF THE INVENTION

The present invention provides a fold flat assembly capable of being erected into a display hutch having a shell and a tray assembly attached to an inner surface of the shell. The shell has opposed side walls spaced from one another and each having a front edge and a rear edge. A back panel connects the rear edges and a plurality slats connect portions of the front edges of the opposing side walls and are spaced from one another defining gaps between adjacent slats. The shell is moveable between a flat position and an erect position. The tray assembly has a peripheral wall and a bottom wall. The peripheral wall is connected to the back panel, the opposed side walls and one of the slats of the plurality of slats. The bottom wall is connected by a first hinge to a segment of the peripheral wall. The tray assembly folds flat within the shell and a portion of the bottom wall extends into the gap when the shell is in the flat position, and the bottom wall forms a shelf, spanning from the one slat to the back panel, when the shell is in the erect position.

Other aspects of the invention are shown in the Figures and are described herein.

BRIEF DESCRIPTION OF THE DRAWINGS

To understand the present invention, it will now be described by way of example, with reference to the accompanying drawings and attachments in which.

DETAILED DESCRIPTION

Figure 1:
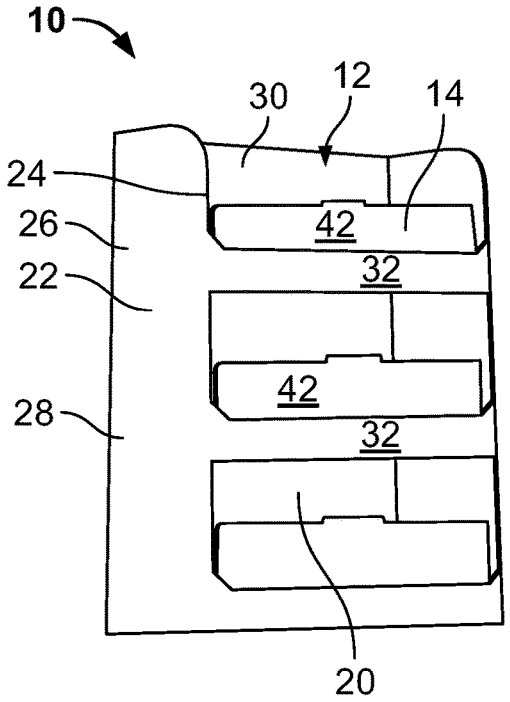
FIG. 1 is a plan view of a display hutch in a flat position.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
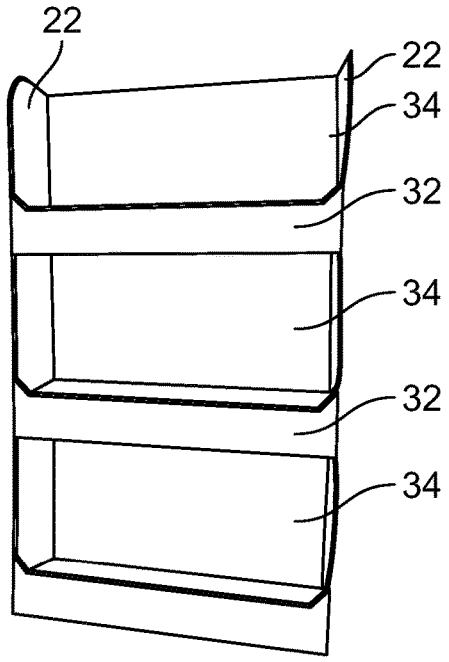
FIG. 2 is a perspective view of a display hutch in an erect position.

FIG. 1 shows a fold flat assembly 10 in a flat position capable of being pressed by hand into a display hutch (FIGS. 2 and 3) by an end user without the use of tools, glue or tape. The assembly 10 may be sometimes referred to as "the hutch." The assembly 10 has an outer shell 12 formed from a blank 100 (FIG. 3), and one or more tray assemblies 14 formed from a blank 200 (FIG. 2). The display hutch can be shipped to a retail location where an end user can press the assembly into the erect position, and the hutch is moved to a desired location and loaded with items for sale. The blanks 100,200 can be made from paperboard, corrugated plastic material, plastic sheeting or other material well known to those of ordinary skill in the art. One method for forming the blanks is by die cutting. Fold lines can be created by scoring, pressing or any methods or means for creating a line of weakness along which panels will fold.

Figure 3:
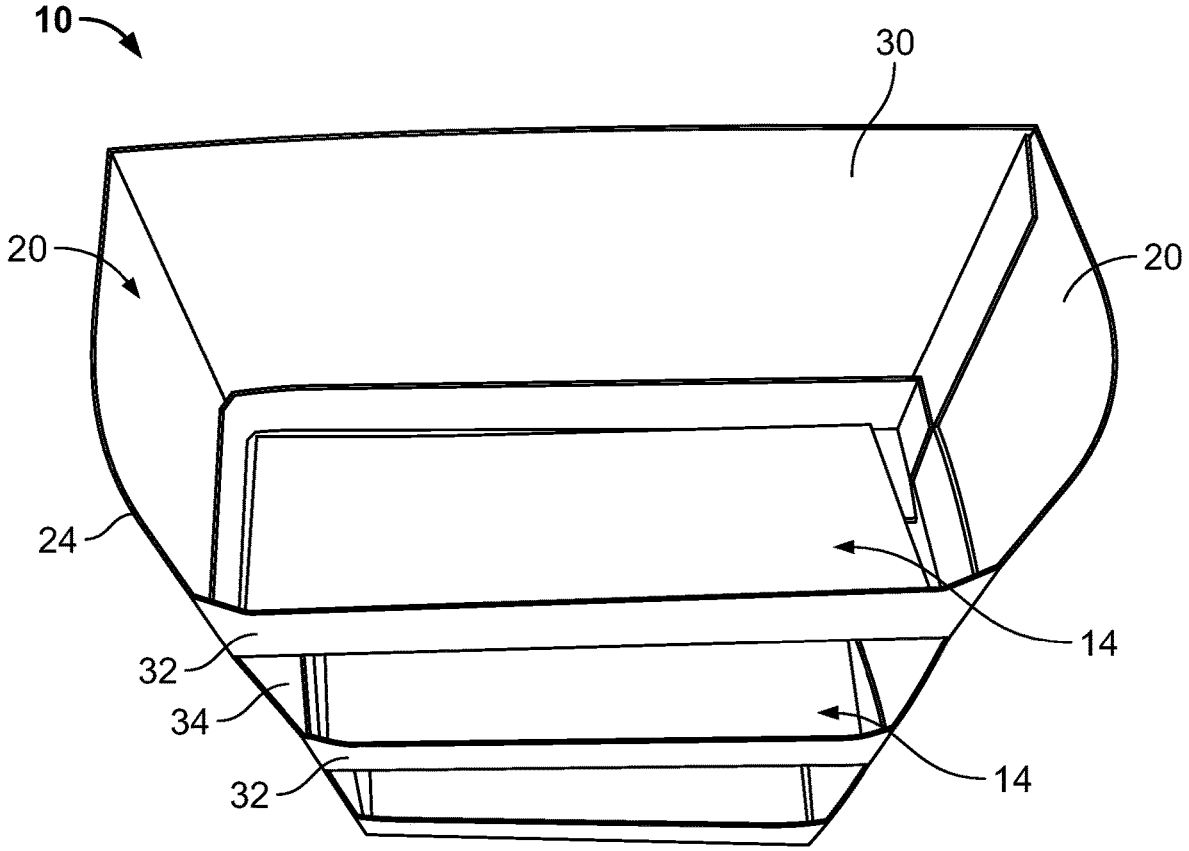
FIG. 3 is a plan view of the display hutch.
Figure 4:
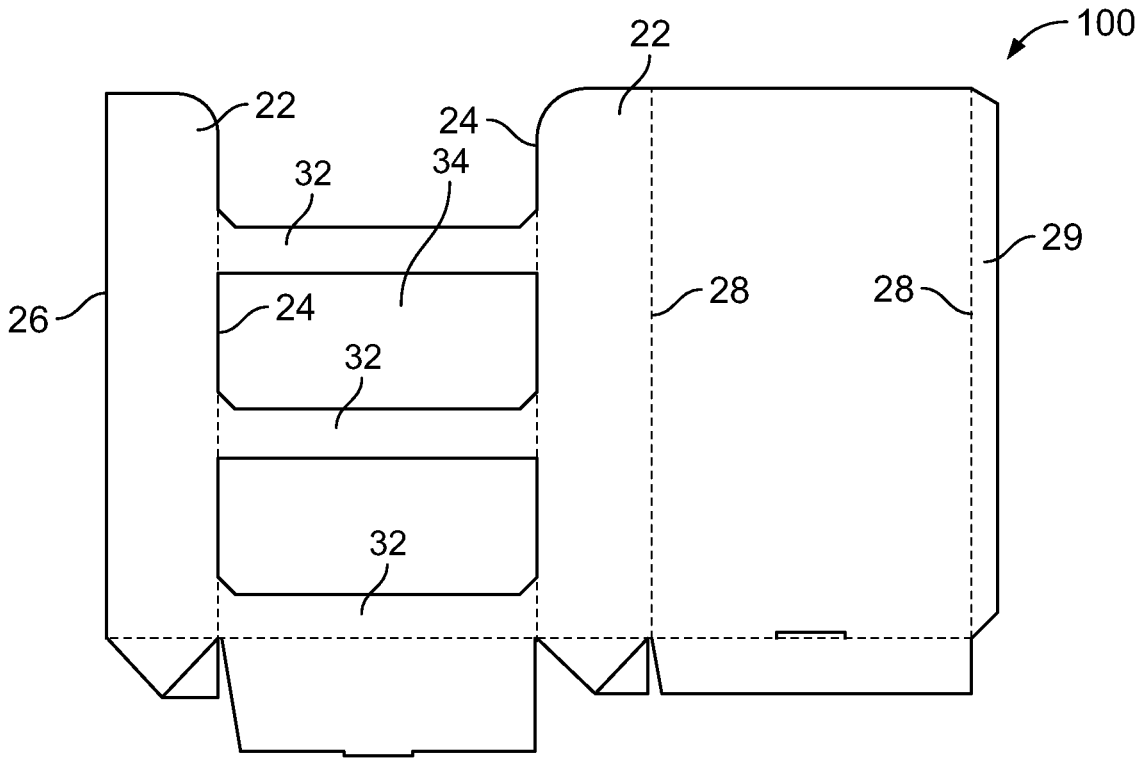
FIG. 4 is a plan view of a blank for forming a shell.

The shell 12 has an inner surface 20 and opposed side walls 22 spaced from one another. Each side wall 22 has a front edge 24 and a rear edge 26. A back panel 30 connects to the rear edges 26 along a fold line 28 and a plurality of slats 32 connect portions of the front edges 24 of the opposing side walls 22 and are spaced from one another defining gaps 34 between adjacent slats. When the assembly 10 is oriented vertically as shown in FIGS. 1-3, the slats 32 and the gaps 34 are vertically spaced from one another.

Figure 5A:
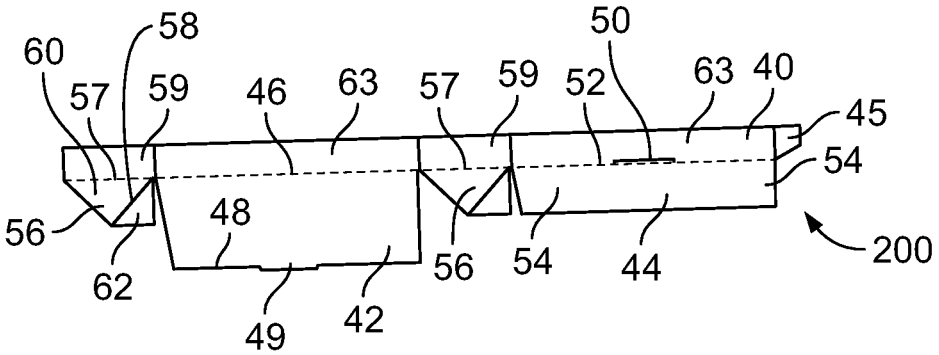
FIG. 5A is a plan view of a blank for forming a tray assembly.
Figure 6:
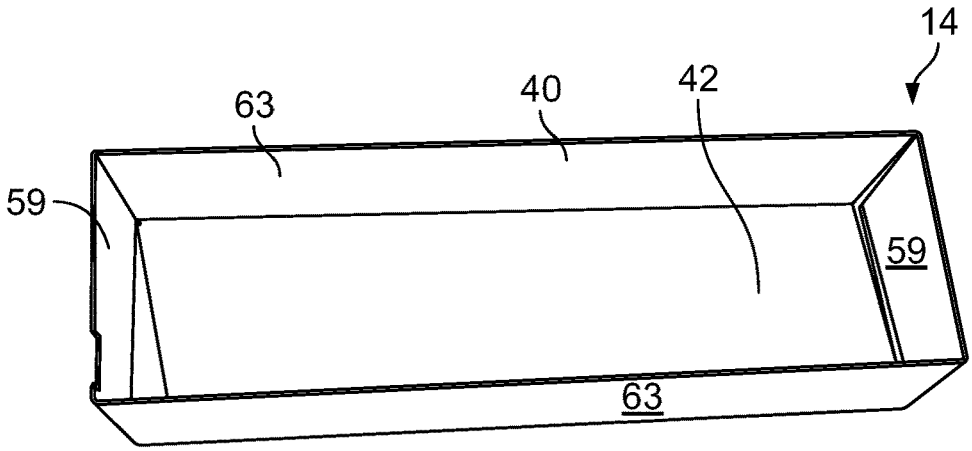
FIG. 6 is a plan view of a tray assembly.
Figure 7:
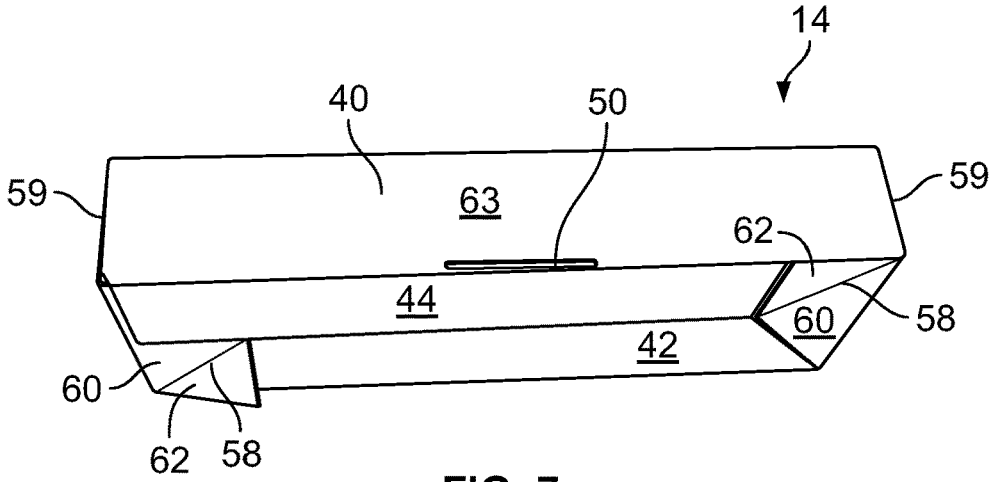
FIG. 7 is a plan view of a rear edge and bottom of the tray assembly.

The tray assembly 14 or tray assemblies are connected to the inner surface 20 of the shell by glue or tape. The hutch is shown with two tray assemblies but the hutch could have from one tray assembly to say 10 tray assemblies, for example. As best seen in FIG. 5A, the tray assembly 14 has a peripheral wall 40, a bottom wall 42, a flap 44 and a connecting flange 45. The peripheral wall is folded from the blank 200 into a rectangular sleeve having four vertically upstanding segments that form a rectangular hoop or sleeve as shown in FIG. 6. Two segments 63 form opposed sidewalls and two segments form opposed end walls 59. The connecting flange 45 is attached to an inner surface of an end wall 59 by glue or tape or other suitable method. In one form of the tray assembly only the two segments 63 are attached to the slats 32 and rear wall 30; however, all four segments of the peripheral wall could be attached to an inner surface 20 of the shell. The peripheral wall 40 could have from 3-8 segments and can form other polygonal-shaped sleeves such as triangular, square, pentagonal, hexagonal, heptagonal and octagonal, for example.

The bottom wall 42 is generally rectangular in shape and is connected to the peripheral wall along a fold line or hinge 46. Opposite of the fold line 46, the bottom wall 42 has a forward edge 48 and a tab 49 generally centrally disposed thereon. The tab 49 is dimensioned to fit within a slot 50 cut through a segment of the peripheral wall. The bottom wall forms a shelf for supporting products on display spanning from the slat 32 to the back panel 30. When the tray assembly 14 is in the flat position, a portion of the bottom wall 42 extends above an upper edge of the slat 32 and into the gap 34 as is shown in FIG. 1.

The flap 44 is generally rectangular in shape and is connected along a fold line or hinge 52 that depends from an opposing segment of the peripheral wall 40 from the hinge 46 from which the bottom wall 42 depends. The bottom wall 42 and the flap 44 are moved between the flat position and the erect position with the assistance of the corner flanges 56 and in response to pressure applied to the opposed side walls 22 inwardly of the hutch 10 by a user of the hutch.

The corner flanges 56 are attached by a hinge or fold line 57 to opposed segments of the peripheral wall that form vertically upstanding opposed end walls 59 when the hutch is in an erect position. The corner flanges 56 have a diagonally extending fold line 58 dividing the corner flange into two generally triangular shaped segments 60 and 62.

Figure 8:
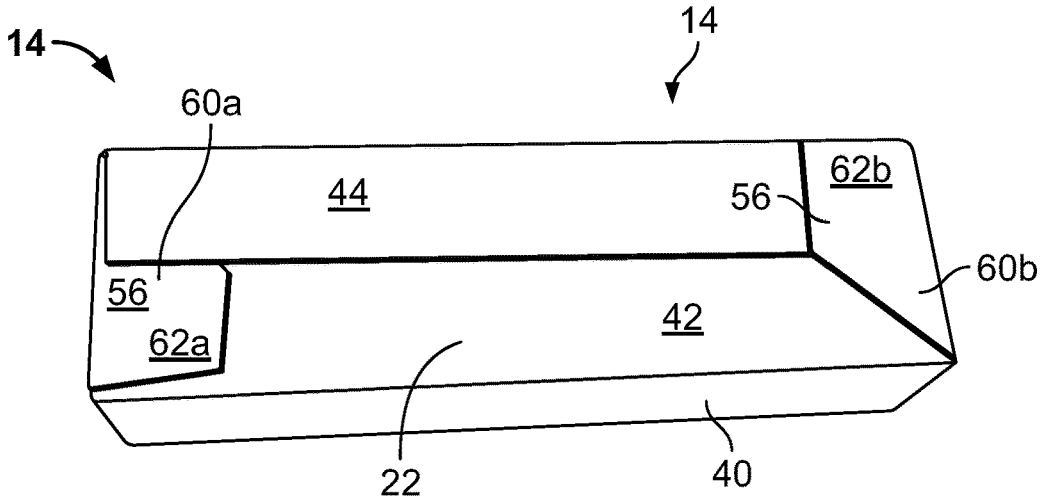
FIG. 8 is a plan view of a bottom of a tray assembly.

As is shown in FIG. 8, one of each of the corner flange segments 62 are connected to an outer surface of each of the bottom wall 42 and the flap 44 by adhesive or tape. The corner flange segment 62*a* is attached to the bottom wall 42 and its associated flange 60*a* is in face-to-face contact with an inside surface of the flap 44. Conversely, the corner flange segment 62*b* is attached to an outer surface of the flap 44 and has its associated flange 60*b* in face-to-face contact with an outer surface of the bottom wall 42. When the tray assembly is in the flat position, the corner flanges 56 fold flat along the fold line 5. Upon being moved from the flat position (FIG. 1) to the erect position (FIG. 2), the corner flanges moves from a flat state, or stowed position to an extended state or deployed position. When in the flat state, a portion of the segments 60,62 overlap one another. When in the extended state the segments are essentially coplanar. During movement between these positions, the bottom wall 42 and the flap 44 rotate 90° about the hinges 46 and 52 respectively. For example, if the hutch is oriented vertically, this means the bottom wall 42 and the flap 44 move from a vertical position to a horizontal position. The tab 49 can then be inserted into the slot 50 to form a shelf.

Figure 5B:
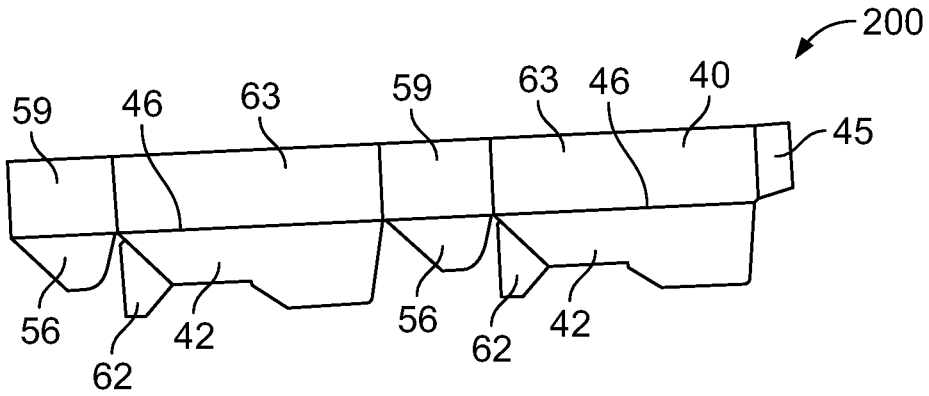
FIG. 5B is a plan view of an alternate blank for forming a tray assembly.

FIG. 5B shows an alternate version of a blank 200 to form a tray assembly having a peripheral wall 40, a connecting flange or glue tab 45, two panels 63 for forming opposed sidewalls and two panels 59 for forming end panels 59. Two panels 42 are used to form the bottom wall of the tray by folding together and releasably interlocking with one another. The corner flanges 56 do not have a fold line as the blank shown in FIG. 5A. The flange segment 62 is moved to the bottom panel 42. Thus, this embodiment does not have a flap 42, a tab 49 or a slot 50.

Figure 9:
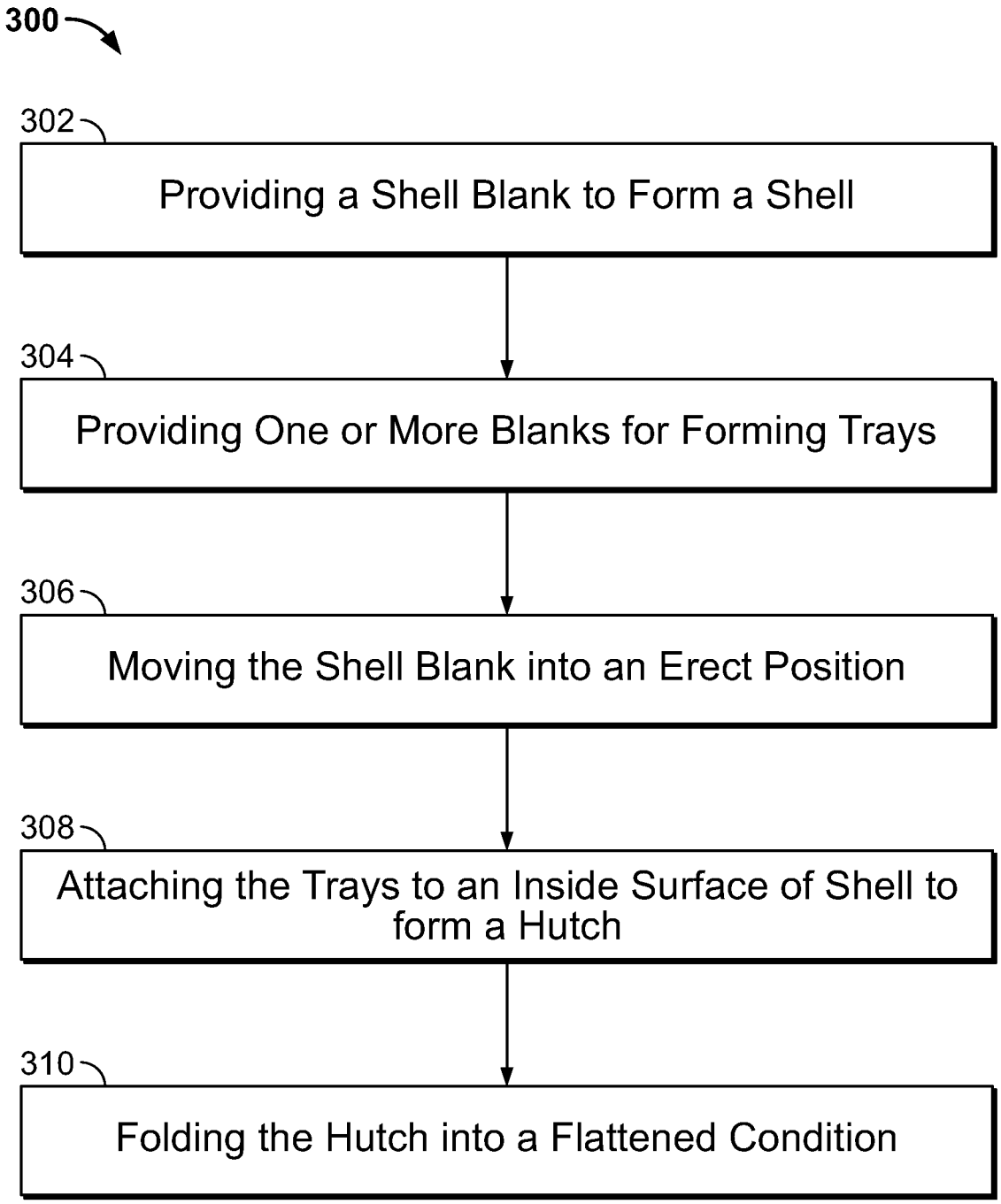
FIG. 9 is a flowchart of a method of the present invention.

FIG. 9 shows the steps in a method 300 for using the hutch. The first steps 302, 304 are providing the blank 100 for forming a shell (shell blank) and one or more of the blanks 200 for forming a tray assembly 14 or tray assemblies 14. The blanks 100 and 200 are described above. Step 306 requires moving the shell blank 100 into an erect position forming a generally rectangular hoop defining a chamber. In step 308, the tray blank or tray blanks 200 are inserted into the rectangular hoop and attached to an inner surface of the rectangular hoop to form a hutch 308. If more than one tray blank 200 is used it should be spaced from any other tray blanks 200 in the hutch. The completed hutch can be moved by hand from an erect condition to a collapsed condition.

As used herein, directional terms such as left/right, top/bottom, vertical, etc. are used with regard to the invention as shown in the figures or as normally positioned in use. They are not meant to limit the invention to a particular position.

Many modifications and variations of the present invention are possible in light of the above teachings. It is, therefore, to be understood within the scope of the appended claims the invention may be protected otherwise than as specifically described.

I claim:

1. A fold flat assembly capable of being erected into a display hutch comprising:

a shell having an inner surface, opposed side walls spaced from one another and each having a front edge and a rear edge, a back panel connecting the rear edges, a plurality of slats connecting portions of the front edges and spaced from one another defining gaps between adjacent slats, the shell being moveable between a flat position and an erect position; and a tray assembly connected to the inner surface and having a peripheral wall and a bottom wall, the peripheral wall being connected to the back panel, the opposed side walls and one of the slats of the plurality of slats, the bottom wall is connected by a first hinge to a segment of the peripheral wall, the bottom wall has a forward edge opposite the first hinge and has a tab depending from a portion of the forward edge and generally centrally disposed, the peripheral wall has a portion removed to define a slot for receiving the tab, the tray assembly folds flat within the shell and a portion of the bottom wall extends into one of the gaps when the shell is in the flat position, and the bottom wall forms a shelf spanning from the one slat to the back panel when the shell is in the erect position.

2. The assembly of claim 1 wherein the tray assembly has a flap connected to a portion of the peripheral wall by a second hinge opposed to the first hinge.

3. The assembly of claim 2 further comprising a first corner flange connected to a portion of the peripheral wall and for connecting to a portion of the flap and being moveable from a stowed position to a deployed position.

4. The assembly of claim 3 wherein the first corner flange extends along a first line and the first hinge extends along a second line generally perpendicular to the first line.

5. The assembly of claim 3 wherein the first corner flange has a centrally disposed fold line.

6. The assembly of claim 5 wherein the centrally disposed fold line extends along a third line that forms an acute angle with the first line.

7. The assembly of claim 3 wherein the flap supports the bottom wall when the shell is in the erect position.

8. The assembly of claim 1 wherein the shell has three slats and two tray assemblies.

9. The assembly of claim 1 wherein the shell forms a generally polygonal sleeve when in the erect position having opposed ends, a major flap is connected to one end of the shell by a third hinge to close one end of the shell and folds flat when the shell is in a flat position.

10. The assembly of claim 9 wherein the major flap has a forward edge supporting a tab.

11. The assembly of claim 10 wherein the back panel has a portion removed to form a slot for receiving the tab of the major flap.

12. The assembly of claim 9 further comprising a minor flap connected to the shell by a fourth hinge opposed to the third hinge.

13. The assembly of claim 12 further comprising a second corner hinge connecting a portion of the minor flap to one of the side walls.

14. The assembly of claim 13 further wherein the fourth hinge extends from the back panel.

15. The assembly of claim 1 further comprising a first glue tab extending from a lateral edge of the back panel.

16. The assembly of claim 1 further comprising a second glue tab on the peripheral wall.

17. The assembly of claim 1 wherein the hutch can be moved back and forth from the flat position to the erect position.

18. A fold flat assembly capable of being erected into a display hutch comprising:

a shell having an inner surface, opposed side walls spaced from one another and each having a front edge and a rear edge, a back panel connecting the rear edges, a plurality of slats connecting portions of the front edges and spaced from one another defining gaps between adjacent slats, the shell being moveable between a flat position and an erect position; and a tray assembly connected to the inner surface and having a peripheral wall and a bottom wall, the peripheral wall being connected to the back panel, the opposed side walls and one of the slats of the plurality of slats, the bottom wall is connected by a first hinge to a segment of the peripheral wall, the bottom wall has a forward edge opposite the first hinge and has a tab depending from a portion of the forward edge and generally centrally disposed, wherein the tray assembly has a flap connected to a portion of the peripheral wall by a second hinge opposed to the first hinge, a first corner flange connected to a portion of the peripheral wall and for connecting to a portion of the flap and being moveable from a stowed position to a deployed position, the tray assembly folds flat within the shell and a portion of the bottom wall extends into one of the gaps when the shell is in the flat position, and the bottom wall forms a shelf spanning from the one slat to the back panel when the shell is in the erect position.

19. The assembly of claim 18 wherein the first corner flange extends along a first line and the first hinge extends along a second line generally perpendicular to the first line.

20. The assembly of claim 19 wherein the first corner flange has a centrally disposed fold line.

21. The assembly of claim 20 wherein the centrally disposed fold line extends along a third line that forms an acute angle with the first line.

22. The assembly of claim 18 wherein the flap supports the bottom wall when the shell is in the erect position.

* * * * *